US010663258B2

(12) United States Patent
Choi

(10) Patent No.: US 10,663,258 B2
(45) Date of Patent: May 26, 2020

(54) GUNNERY CONTROL SYSTEM AND GUNNERY CONTROL METHOD USING THE SAME

(71) Applicant: HANWHA DEFENSE CO., LTD., Changwon-si (KR)

(72) Inventor: Dong Hwan Choi, Changwon-si (KR)

(73) Assignee: HANWHA DEFENSE CO., LTD., Changwon-si (KR)

( * ) Notice: Subject to any disclaimer, the term of this patent is extended or adjusted under 35 U.S.C. 154(b) by 0 days.

(21) Appl. No.: 16/063,021

(22) PCT Filed: Dec. 14, 2016

(86) PCT No.: PCT/KR2016/014680
§ 371 (c)(1),
(2) Date: Jun. 15, 2018

(87) PCT Pub. No.: WO2017/105095
PCT Pub. Date: Jun. 22, 2017

(65) Prior Publication Data

US 2018/0372451 A1 Dec. 27, 2018

(30) Foreign Application Priority Data

Dec. 16, 2015 (KR) ..... 10-2015-0180219

(51) Int. Cl.
*F41G 3/16* (2006.01)
*F41G 3/06* (2006.01)
(Continued)

(52) U.S. Cl.
CPC ..... *F41G 3/16* (2013.01); *F41G 3/02* (2013.01); *F41G 3/06* (2013.01); *F41G 5/06* (2013.01); *G08C 17/02* (2013.01)

(58) Field of Classification Search
CPC ..... F41G 3/00; F41G 3/02; F41G 3/06; F41G 3/14; F41G 3/16; F41G 5/06
(Continued)

(56) References Cited

U.S. PATENT DOCUMENTS 9,372,070 B1 * 6/2016 Jancic ..... G01B 11/026
2004/0050240 A1 * 3/2004 Greene ..... F41G 3/06 89/41.06
(Continued)

FOREIGN PATENT DOCUMENTS

JP 2009-133558 A 6/2009
JP 2013-117362 A 6/2013
(Continued)

OTHER PUBLICATIONS

International Search Report (PCT/ISA/210) dated Mar. 20, 2017 issued by the International Searching Authority in counterpart International Application No. PCT/KR2016/014680.
(Continued)

*Primary Examiner* — Stephen Johnson
*Assistant Examiner* — Benjamin S Gomberg
(74) *Attorney, Agent, or Firm* — Sughrue Mion, PLLC

(57) ABSTRACT

Provided are a gunnery control system and a gunnery control method using the gunnery control system. The gunnery control system includes: an imaging device configured to photograph a target and to measure a distance to the target and a degree of a turning angle to the target; a gunnery device configured to fire at the target; and a controller configured to receive, from the imaging device, location information of the imaging device, the gunnery device, and the target, and to control a firing operation of the gunnery device by using the location information, wherein the controller is further configured to control a location and a
(Continued)

photographing direction of the imaging device and to control a location and a firing direction of the gunnery device.

20 Claims, 6 Drawing Sheets

(51) Int. Cl.
*G08C 17/02* (2006.01)
*F41G 5/06* (2006.01)
*F41G 3/02* (2006.01)

(58) Field of Classification Search
USPC ..... 89/41.05
See application file for complete search history.

(56) References Cited

U.S. PATENT DOCUMENTS

2008/0008354 A1* 1/2008 Milbert ..... F41G 3/02 382/103
2009/0164045 A1* 6/2009 Deguire ..... G05D 1/0038 700/259
2009/0292467 A1* 11/2009 McNelis ..... F41G 3/06 701/300
2013/0192451 A1* 8/2013 Scott ..... F41G 3/00 89/41.05
2014/0251123 A1* 9/2014 Venema ..... F41G 3/16 89/41.22
2015/0345907 A1* 12/2015 Varga ..... F41G 3/147 89/41.05

FOREIGN PATENT DOCUMENTS

KR 10-1999-0047764 A 7/1999
KR 10-2010-0068810 A 6/2010
KR 10-2012-0050180 A 5/2012
KR 10-2013-0029255 A 3/2013
KR 10-2014-0087832 A 7/2014
KR 10-2015-0100125 A 9/2015
WO 2013/039312 A1 3/2013
WO WO-2013039312 A1 * 3/2013 ..... F41G 3/04

OTHER PUBLICATIONS

Written Opinion (PCT/ISA/237) dated Mar. 20, 2017 issued by the International Searching Authority in counterpart International Application No. PCT/KR2016/014680.

* cited by examiner

GUNNERY CONTROL SYSTEM AND GUNNERY CONTROL METHOD USING THE SAME

TECHNICAL FIELD

The present disclosure relates to a gunnery control system and a gunnery control method using the gunnery control system, and more particularly, to a gunnery control system capable of controlling exact aiming at a target by using a movable imaging device and a gunnery device, and a gunnery control method using the gunnery control system.

BACKGROUND ART

An armament system is a system in which an imaging device controls an armament device for performing precision firing on a target in a situation where a shooter is not exposed in a close- or long-distance combat operation, and allows a combat mission to be performed without harming the shooter.

According to an armament system of the related art, an expensive imaging device has to be mounted for performing remote firing, and the armament system fires at a target through vertical driving or rotational driving at a fixed location.

Also, even when a distance measuring device included in the imaging device is used, there may be a large measurement error at long distances, and thus, there is a need for a method of providing an image of a target by approaching the target as close as possible and reducing the error in measuring the distance.

DESCRIPTION OF EMBODIMENTS

Technical Problem

Provided are a gunnery control system capable of precisely hitting a target even in a case where close shooting and aiming are not possible; and a gunnery control method using the gunnery control system.

Solution to Problem

According to an aspect of the present disclosure, there is provided a gunnery control system including: an imaging device configured to photograph a target and to measure a distance to the target and a degree of a turning angle to the target; a gunnery device configured to fire at the target; and a controller configured to receive, from the imaging device, location information of the imaging device, the gunnery device, and the target, and to control a firing operation of the gunnery device by using the location information, wherein the controller is further configured to control a location and a photographing direction of the imaging device and to control a location and a firing direction of the gunnery device.

The imaging device may be further configured to measure a degree of a turning angle with respect to the target and the gunnery device based on a true north direction. The imaging device may be further configured to measure a distance to the gunnery device.

The controller may be further configured to determine a degree of a turning angle of the gunnery device based on a true north direction, by using the location information transmitted from the imaging device. The imaging device may include a camera and a distance measuring device aligned with the camera.

The controller may be configured to receive an image including the target from the imaging device, and to control a location or a photographing direction of the imaging device such that the target is located at a center of the image.

The controller may be configured to receive an image including the gunnery device from the imaging device, and to control a location or a photographing direction of the imaging device such that the gunnery device is located at a center of the image.

The controller may be configured to perform wireless communication with the imaging device and the gunnery device.

According to an aspect of the present disclosure, there is provided a gunnery control method using a gunnery control apparatus, the gunnery control method including: arranging an imaging device around a target; photographing, by the imaging device, the target, and measuring a distance and a degree of a turning angle to the target; receiving, by the firing control apparatus, location information of a firing device, the imaging device, and the target; and controlling, by the gunnery control apparatus, a firing operation of the gunnery device by using the location information.

In the measuring of the distance and the degree of the turning angle to the target, the imaging device may be configured to measure the degree of the turning angle with respect to the target based on a true north direction, and may be further configured to measure a degree of a turning angle with respect to the gunnery device.

In the measuring of the distance and the degree of the turning angle to the target, the image device may be further configured to measure a distance to the gunnery device.

In the controlling of the firing operation of the gunnery device, the gunnery control apparatus may be configured to determine a degree of a turning angle of the gunnery device based on a true north direction by using the location information received by the gunnery control apparatus from the imaging device.

The imaging device may include a camera and a distance measuring device aligned with the camera.

In the receiving of the location information, the gunnery control apparatus may be further configured to receive an image including the target from the imaging device, and to control a location or a photographing direction of the imaging device such that the target is located at a center of the image.

In the receiving of the location information, the gunnery control apparatus may be further configured to receive an image including the gunnery device from the imaging device, and to control a location or a photographing direction of the imaging device such that the gunnery device is located at a center of the image.

The gunnery control apparatus is configured to perform wireless communication with the imaging device and the gunnery device.

Advantageous Effects of Disclosure

According to the present disclosure, even when it is difficult to perform close shooting and aiming at a target, a gunnery control system capable of precisely hitting the target and a gunnery control method using the gunnery control system may be provided.

BEST MODE

Figure 1:
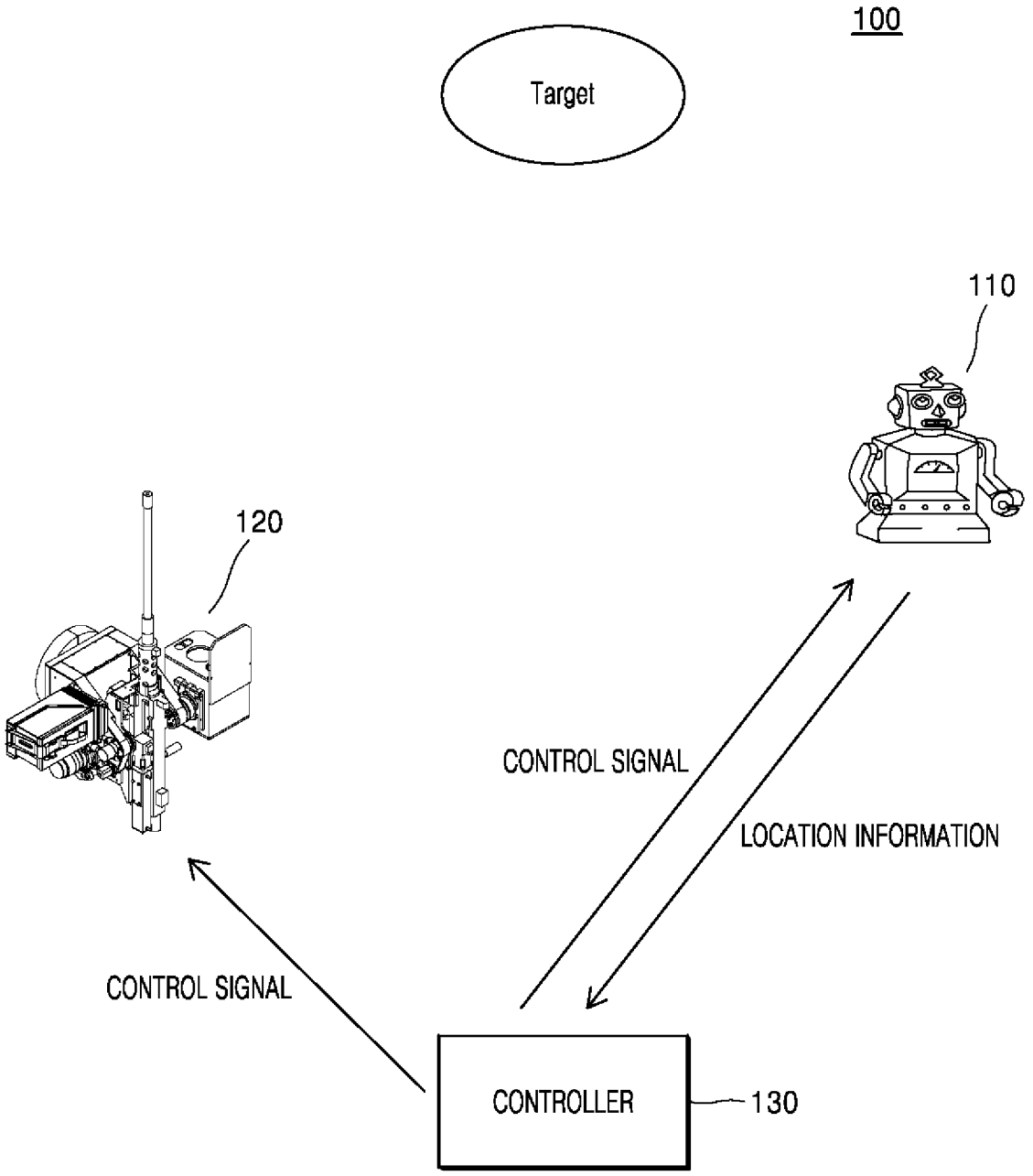
FIG. 1 is a schematic block diagram of a gunnery control system according to an embodiment.

Hereinafter, one or more embodiments of the present disclosure will be described in detail with reference to accompanying drawings. Also, in the present specification and drawings, like reference numerals denote substantially the same components and detailed descriptions thereof are not repeated.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added. It will be understood that although the terms "first," "second," etc. may be used herein to describe various components, these components should not be limited by these terms. These components are only used to distinguish one component from another. These components are only used to distinguish one component from another.

FIG. 1 is a schematic block diagram of a gunnery control system according to an embodiment.

Referring to FIG. 1, a gunnery control system 100 according to an embodiment includes an imaging device 110, a gunnery device 120, and a controller 130.

The imaging device 110 photographs a target, and measures a distance and a turning angle to the target. The target may be a shooting target of the gunnery control system 100, in particular, a target that the gunnery device 120 is to hit. In addition, the imaging device 110 measures the distance to the target, and transfers a measurement result to the controller 130. The imaging device 110 may include a distance measuring device for measuring the distance to the target.

The gunnery device 120 fires at the target, the controller 130 receives location information of the imaging device 110, the gunnery device 120, and the target from the imaging device 110, and then, the controller 130 controls a firing operation of the gunnery device 120 by using the location information.

The location information may be a global positioning system (GPS) coordinate information, and the imaging device 110 may obtain the location information of the target by using the distance to the target, a degree of the turning angle, and location information of itself. Likewise, the imaging device 110 may obtain location information of the gunnery device 120 by using the distance to the gunnery device 120, a degree of the turning angle, and the location information itself.

The controller 130 calculates the distance from the gunnery device 120 to the target and the degree of the turning angle by using the location information obtained from the imaging device 110, and may control the firing operation of the gunnery device 120 in response to the calculated distance and the degree of the turning angle.

In addition, the imaging device 110 and the gunnery device 120 are configured to be movable. In addition, since it is important for the imaging device 110 to exactly measure the rotating angle for firing the target and to capture a clear image of the target, the controller 130 controls a location and a photographing direction of the imaging device 110.

The imaging device 110 may be configured as a moving robot as shown in FIG. 1, and may include a camera for capturing images and a distance measuring device for measuring distances. As the imaging device 110 approaches the target, clearer images may be captured and accuracy in measuring the distance and the turning angle may be improved. Thus, the imaging device 110 may be as small as possible, provided that the camera and the distance measuring device are included.

Also, the imaging device 110 may capture an image of the target and may measure the distance and turning angle to the target by itself, or may be controlled by the controller 130. Thus, the camera and the distance measuring device included in the imaging device 110 may be aligned with each other.

The controller 130 may control the imaging device 110 to capture the image of the target from a front portion, and when the image captured from the front of the target is transmitted, the controller 130 may measure the distance from the imaging device 110 to the target.

The gunnery device 120 may be also controlled by the controller 130, and may be configured to perform a turning drive and an elevation drive. In addition, the gunnery device 120 may be movable according to the control of the controller 130, so as to move to a location for performing an exact firing operation.

Figure 2:
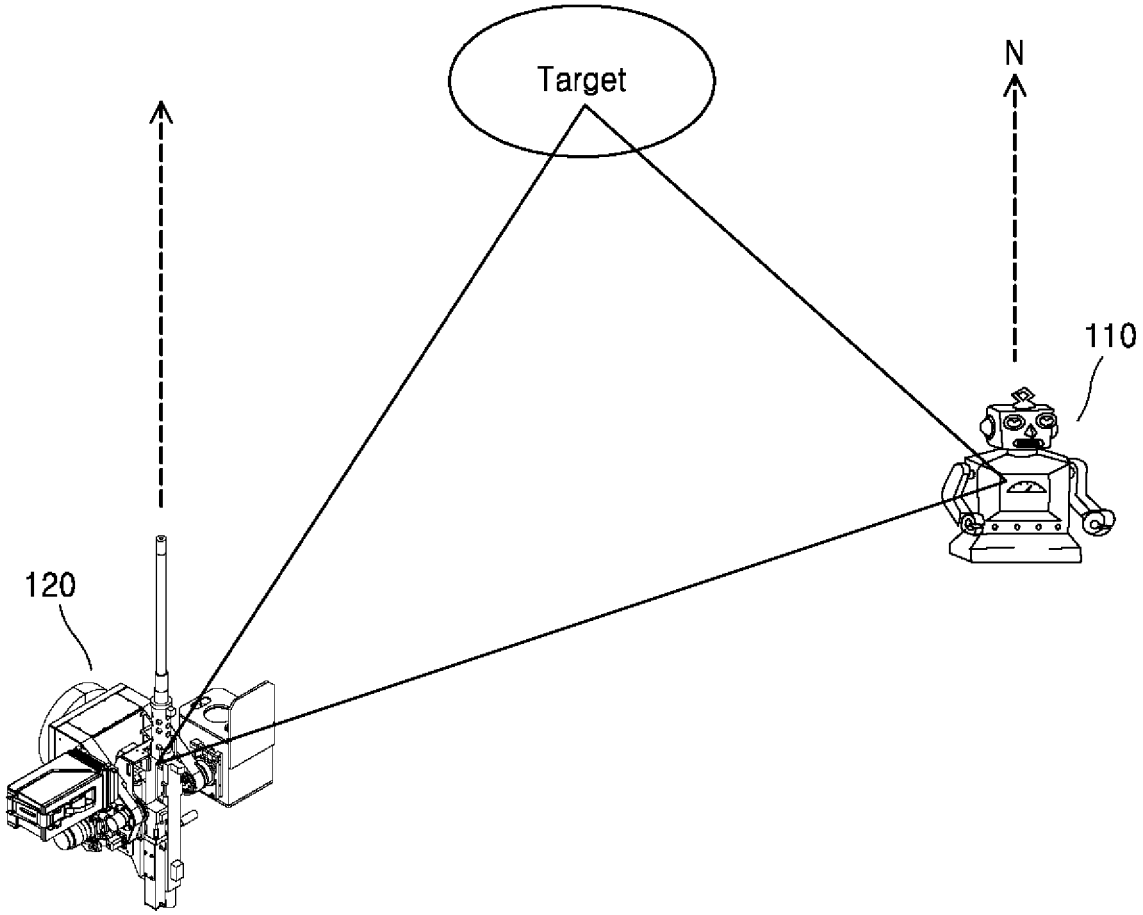
FIG. 2 is a schematic diagram showing a relationship between a target and a gunnery control system according to an embodiment.

FIG. 2 is a schematic diagram showing a relationship between a gunnery control system according to an embodiment and a target.

Referring to FIG. 2, it may be understood that the imaging device 110, the gunnery device 120, and the target form a triangle. Information that the gunnery device 120 needs to fire at the target may basically include the distance from the gunnery device 120 to the target, and the degree of the turning angle of the gunnery device 120 from a current orientation direction to the target.

The imaging device 110 may measure the distance from the imaging device 110 to the target, and may measure the distance from the imaging device 110 to the gunnery device 120. In addition, the imaging device 110 may calculate the turning angle from the orientation direction of itself, that is, the current orientation direction of the camera included in the imaging device 110, to the target.

By using the above numerical values that may be obtained from the imaging device 110, an internal angle formed by the target, the imaging device 110, and the gunnery device 120 may be calculated. In addition, when the internal angle is identified, the degree of the turning angle from the current orientation direction of the gunnery device 120 to the target may be calculated by using the cosine law.

In addition, in order to obtain information about the turning angles of the imaging device 110 and the gunnery device 120, a reference direction is necessary, and in the gunnery control system according to the embodiment, a true north direction becomes the reference direction. In addition, the imaging device 110 and the gunnery device 120 may be arranged, so that the orientation direction of the camera included in the imaging device 110 and the orientation direction of the gunnery device 120 are all in the true north direction.

Therefore, the imaging device 110 may measure the turning angle with respect to the target based on the true north direction, and the turning angle of the gunnery device 120 may be also based on the true north direction.

In addition, information about the distance to the target, the distance to the gunnery device 120, and the turning angle measured by the imaging device 110 is transferred to the controller 130 in real-time, and when the information about the target is changed because the location of the imaging device 110 is changed, the changed information is also transferred to the controller 130 in real-time. Alternately, in a case where the distance from the imaging device 110 to the gunnery device 120 varies and the turning angle of the gunnery device 120 for the firing operation varies because the location of the gunnery device 120 is changed, the changed information is also transferred to the controller 130 in real-time.

Figure 3:
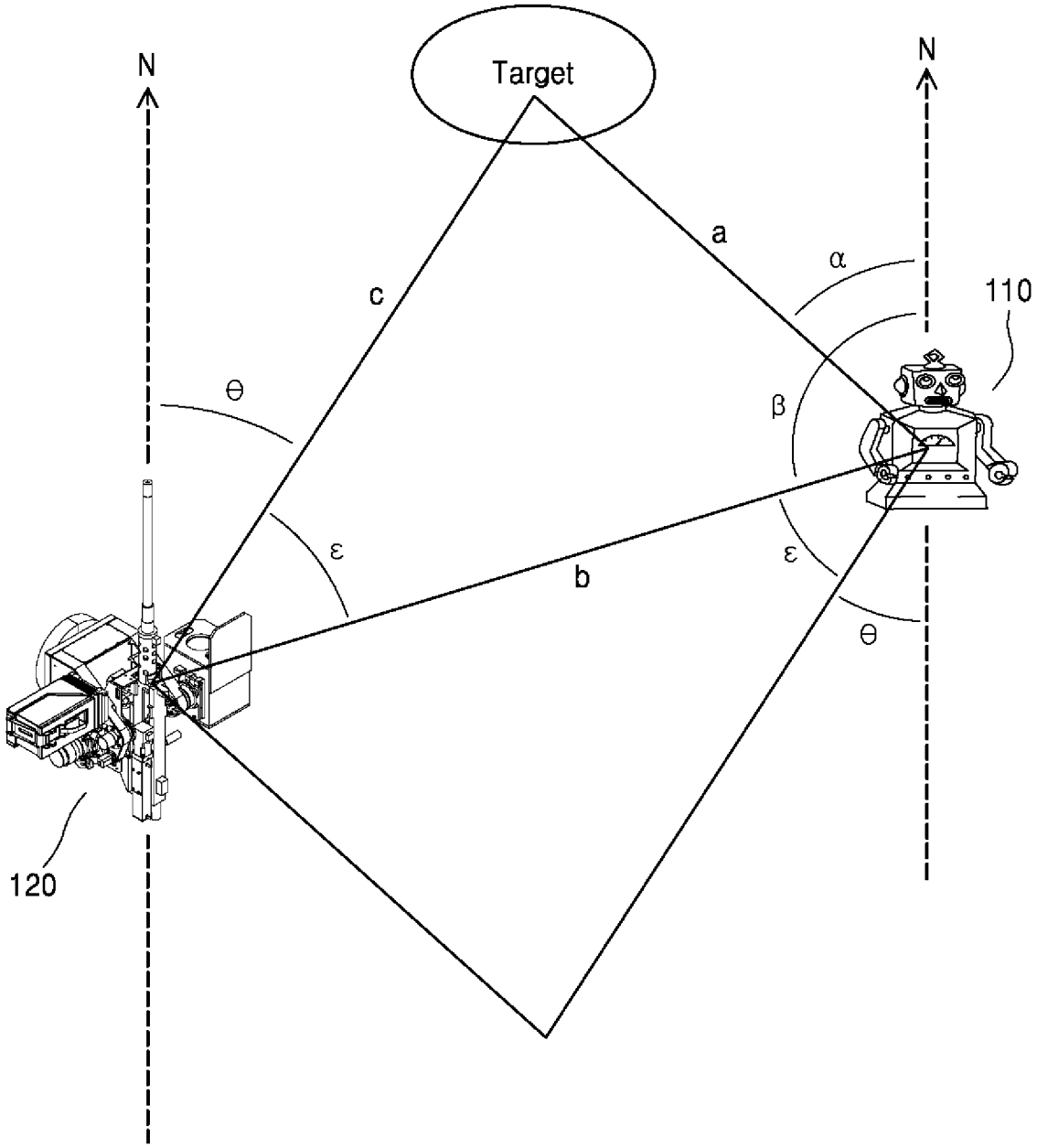
FIG. 3 is a diagram schematically illustrating a process by which a gunnery control system aims at a target, according to an embodiment.

FIG. 3 is a diagram schematically illustrating a process by which a gunnery control system aims at a target, according to an embodiment.

Referring to FIG. 3, the imaging device 110 and the gunnery device 120 both face a true north direction N. That is, the photographing direction of the camera included in the imaging device 110 and the firing direction of the gunnery device 120 are facing the true north direction N.

In addition, the distance between the target and the imaging device 110, the distance between the imaging device 110 and the gunnery device 120, and the distance between the gunnery device 120 and the target are respectively defined as α, b, and c. In addition, a degree of a turning angle from the initial orientation direction of the imaging device 110, e.g., the true north direction N, to the target is defined as α.

Also, a degree of a turning angle from the initial orientation direction of the imaging device 110 to the gunnery device 120 is defined as β, and a degree of a turning angle from the initial orientation direction of the gunnery device 120 to the target is defined as θ.

Here, the distance a between the target and the imaging device 110 and the distance b between the imaging device 110 and the gunnery device 120 may be measured by the distance measuring device included in the imaging device 110. In addition, the degree of turning angle α of the imaging device 110 rotating from the true north direction N towards the target may be obtained by measuring a rotating angle until the target is located at a center of a screen provided by the camera included in the imaging device 110.

In the same manner as above, the degree of turning angle β of the imaging device 110 rotating from the true north direction N towards the gunnery device 120 may be obtained.

In addition, the distance c between the gunnery device 120 and the target and the degree of turning angle θ of the gunnery device 120 rotating from the true north direction N towards the target may be obtained by using the distance a and b and the degrees of the turning angles α and β that may be measured by the imaging device 110.

First, the distance c between the gunnery device 120 and the target may be calculated by the cosine law, and equation below may be obtained.

$$c^2=a^2+b^2-2ab\cos(\beta-\alpha) \quad \text{[Equation 1]}$$

In Equation 1 above, since a, b, α, and β are values that may be measured by the imaging device 110, the distance c between the gunnery device 120 and the target may be calculated.

In addition, the degree of turning angle θ of the gunnery device 120 rotating from the true north direction N towards the target may be calculated by using the internal angle formed by the gunnery device 120, the target, and the imaging device 110. When the internal angle is ε, Equation 2 below may be obtained.

$$\frac{a}{\sin\varepsilon}=\frac{c}{\sin(\beta-\alpha)} \quad \text{[Equation 2]}$$

In Equation 2 above, the other values than c may be obtained in the above processes, a value of c may be also calculated. Therefore, the degree of turning angle θ of the gunnery device 120 may be calculated by using Equation 3 below.

$$\theta=80°-(\beta+\varepsilon) \quad \text{[Equation 3]}$$

As described above, since the distance c between the gunnery device 120 and the target and the degree of turning angle θ of the gunnery device 120 from the true north direction N may be calculated, the target located at a remote distance may be hit in a case where the gunnery device 120 does not include an additional distance measuring device and/or turning angle measuring device.

Figure 4:
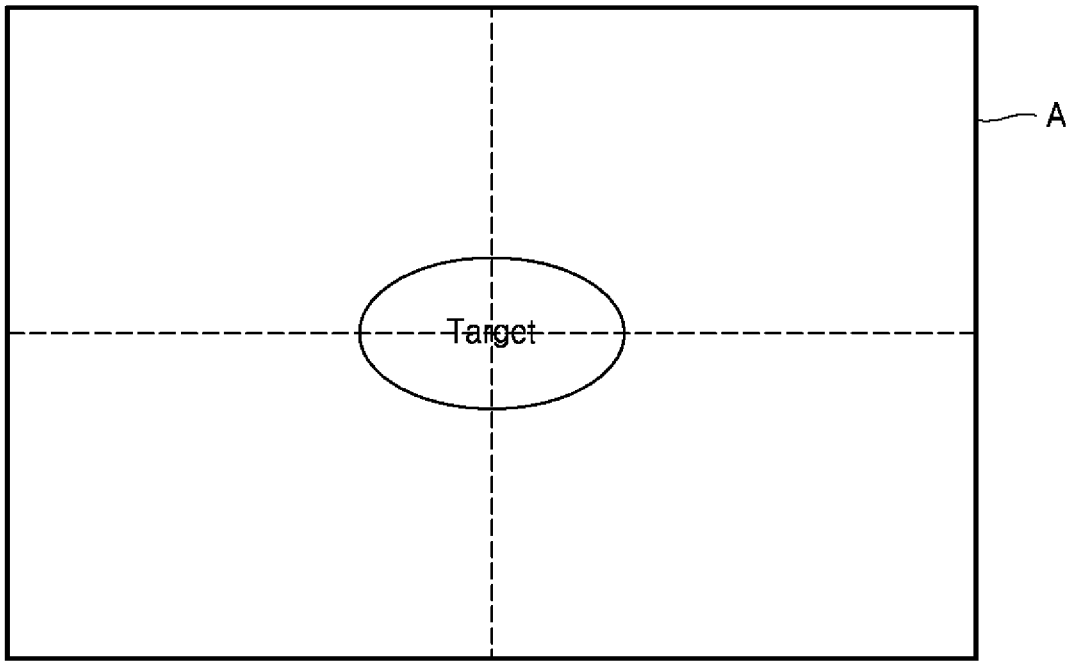
FIGS. 4 and 5 are schematic diagrams respectively illustrating processes of obtaining images of a target and a gunnery device, according to an embodiment.
Figure 5:
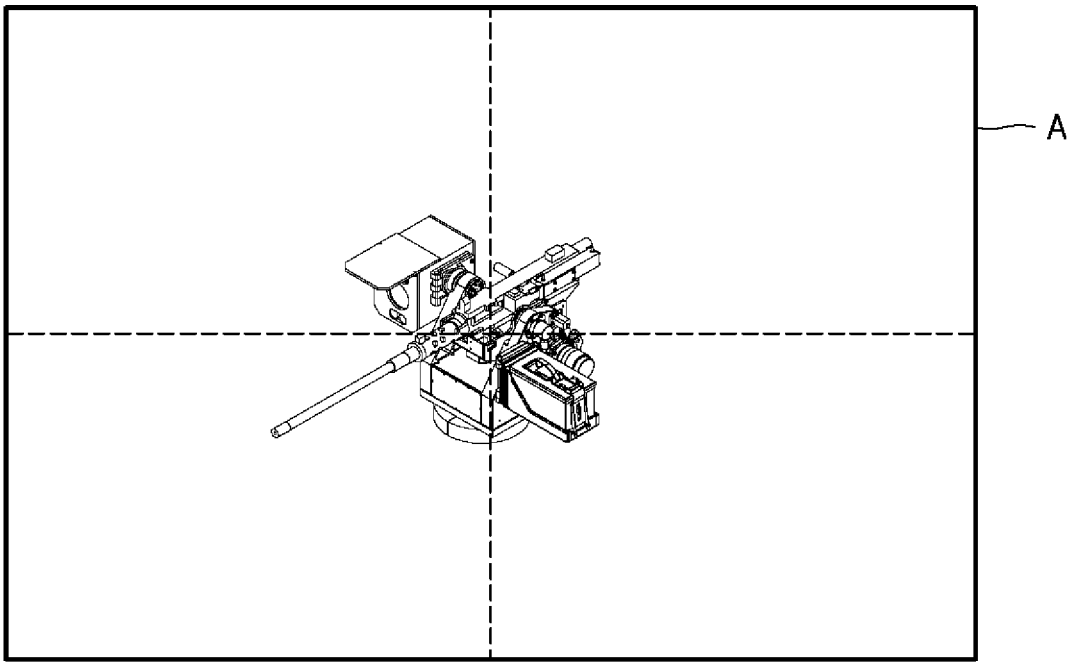

FIGS. 4 and 5 are schematic diagrams respectively illustrating processes of obtaining images of a target and a gunnery device, according to an embodiment.

FIGS. 4 and 5 exemplary and simply show a screen displaying an image captured and transferred to the controller 130 by the imaging device 110 included in the gunnery control system 100, as described above with reference to FIGS. 1 to 3. In FIGS. 4 and 5, a display screen A may be understood as a displaying region of a display screen included in the controller 130.

Referring to FIG. 4, the controller 130 controls the imaging device 110 to capture an image of the target, and controls the location and photographing direction of the imaging device 110 to make the target located at a center of the display screen A.

As described above with reference to FIG. 2, at a time of arranging the imaging device 110, it is understood that the camera included in the imaging device 110 faces the true north direction N, and the camera 130 controls the photographing direction of the imaging device 110 until the target is located at the center of the display screen A.

In addition, the imaging device 110 measures the turning angle of the camera, that is, the imaging device 110, until the target is located at the center of the display screen A, and may transfer information about the measured degree of the turning angle to the camera 130.

When the target is located at the center of the display screen A, the controller 130 controls the imaging device 110 to measure the distance from the imaging device 110 to the target. The imaging device 110 may transfer information about the measured distance to the controller 130.

In addition, referring to FIG. 5, the controller 130 controls the imaging device 110 to capture an image of the gunnery device 120, and may control the location and the photographing direction of the imaging device 110 so that the gunnery device 120 is located at the center of the display screen A.

As described above with reference to FIG. 2, at a time of arranging the imaging device 110, it is understood that the camera included in the imaging device 110 faces the true north direction N, and the camera 130 controls the photographing direction of the imaging device 110 until the gunnery device 120 is located at the center of the display screen A.

In addition, the imaging device 110 measures the turning angle of the camera, that is, the imaging device 110, until the gunnery device 120 is located at the center of the display screen A, and may transfer information about the measured degree of the turning angle to the camera 130.

When the gunnery device 120 is located at the center of the display screen A, the controller 130 controls the imaging device 110 to measure the distance from the imaging device 110 to the gunnery device 120. The imaging device 110 may transfer information about the measured distance to the controller 130.

MODE OF DISCLOSURE

Figure 6:
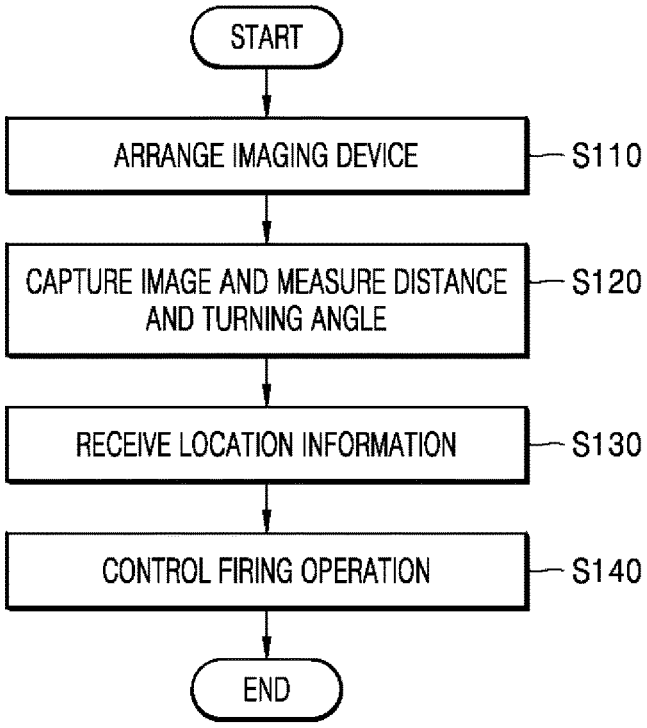
FIG. 6 is a flowchart schematically illustrating an operation sequence of a gunnery control method according to an embodiment.

FIG. 6 is a flowchart schematically illustrating an operation sequence of a gunnery control method according to an embodiment.

Referring to FIG. 6, the gunnery control method according to the embodiment uses a gunnery control apparatus, and includes a process of arranging an imaging device (S110), a process of photographing and measuring a distance and a turning angle (S120), a process of receiving location information (S130), and a process of controlling a firing operation (S140). The gunnery control apparatus may be understood as an apparatus including substantially the same components and performing substantially the same functions as those of the gunnery control system 100 as described above with reference to FIGS. 1 to 5.

In the process of arranging the imaging device (S110), the imaging device is arranged around the target. The imaging device may be an element included in the gunnery control apparatus, and may include a camera for photographing the target. In addition, the imaging device is a movable device that may be arranged at a location hidden from an enemy, provided that a clear image of the target may be obtained.

In the process of photographing and measuring the distance and the turning angle (S120), the imaging device photographs the target, and measures the distance and the turning angle to the target.

The imaging device includes a distance measuring device in addition to the camera, and measures the distance to the target by using the distance measuring device. In addition, at a time point of initially arranging the imaging device, an orientation direction of the imaging device and a photographing direction of the camera may be in a true north direction N, and the imaging device measures a degree of the turning angle from the true north direction N to the target.

In a case where the direction of the imaging device and the photographing direction of the camera are not in the true north direction N, the degree of the turning angle to the target may be measured in a state where the directions of the imaging device and the camera are set in the true north direction N.

In the process of receiving the location information (S130), the gunnery control apparatus receives location information of the gunnery device, the imaging device, and the target. The location information may be a global positioning system (GPS) coordinate information, and the imaging device may obtain the location information of the target by using the distance to the target, a size of the turning angle, and location information of itself.

Otherwise, the imaging device and the gunnery device may include a GPS sensor, and the gunnery control apparatus may obtain the location information of the imaging device and the gunnery device from the GPS sensor.

Otherwise, in the process of photographing and measuring the distance and the turning angle (S120), the imaging device may photograph the gunnery device and measures the distance and the degree of the turning angle to the gunnery device, transfer information about the measured distance and the degree of the turning angle to the gunnery control apparatus, and obtain location information of the gunnery device by using the information about the distance and the degree of the turning angle.

In addition, the gunnery control apparatus may receive information from the imaging device, and may perform wireless communication with the imaging device and the gunnery device in order to control the imaging device and the gunnery device.

In the process of controlling the firing operation (S140), the gunnery control apparatus controls the firing operation of the gunnery device by using the location information. The gunnery control apparatus calculates a distance and a degree of a turning angle from the gunnery device to the target by using the above obtained information, and controls the firing operation of the gunnery device in response to the calculated distance and degree of the turning angle.

Figure 7:
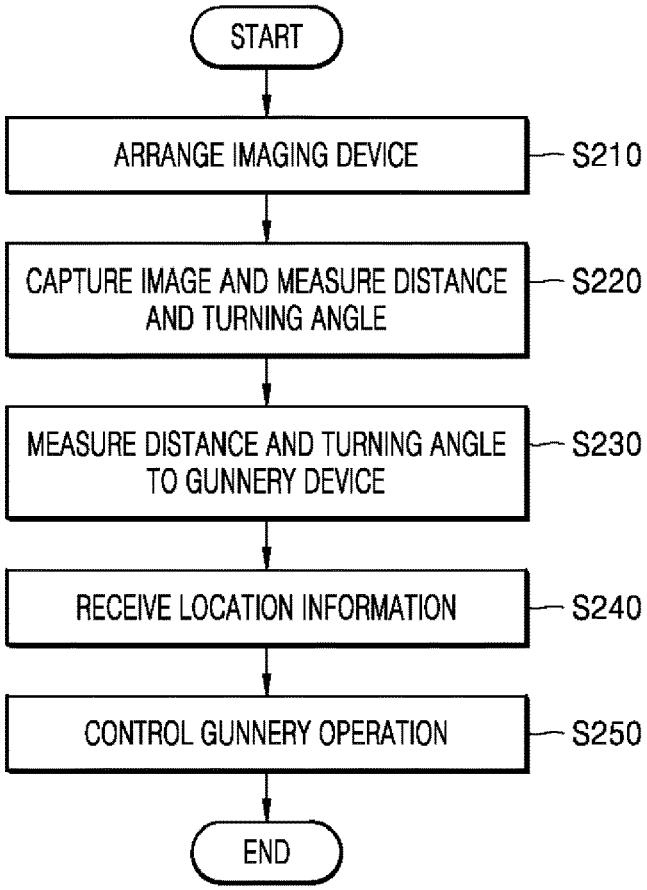
FIG. 7 is a flowchart schematically illustrating an operation sequence of a gunnery control method according to another embodiment.

FIG. 7 is a flowchart schematically illustrating an operation sequence of a gunnery control method according to another embodiment.

Referring to FIG. 7, the gunnery control method according to another embodiment includes a process of arranging an imaging device (S210), a process of photographing and measuring a distance and a turning angle (S220), a process of measuring a distance and a turning angle to a gunnery device (S230), a process of receiving location information (S240), and a process of controlling a firing operation (S250).

In the above process of arranging the imaging device (S210), the process of photographing and measuring the distance and the turning angle (S220), the process of receiving the location information (S240), and the process of controlling the gunnery operation (S250), substantially the same operations as those of the above process of arranging the imaging device (S110), the process of photographing and measuring the distance and the turning angle (S120), the process of receiving the location information (S130), and the process of controlling the firing operation (S140) described above with reference to FIG. 6 are performed, and detailed descriptions thereof are omitted.

In the process of measuring the distance and the turning angle to the gunnery device (S230), the imaging device measures the distance and the degree of the turning angle to the gunnery device. Here, the imaging device measures the degree of the turning angle from the true north direction N to the gunnery device.

In addition, in the process of receiving the location information (S240), the gunnery control apparatus may receive information about the distance from the imaging device to the target, the degree of the turning angle from the imaging device to the target, the distance from the imaging device to the gunnery device, and the degree of the turning angle from the imaging device to the gunnery device.

Otherwise, the imaging device may calculate location information of the target and the gunnery device by using location information of itself and information about distances and degrees of turning angles to the target and the gunnery device, and may provide the calculated location information to the gunnery control apparatus.

Figure 8:
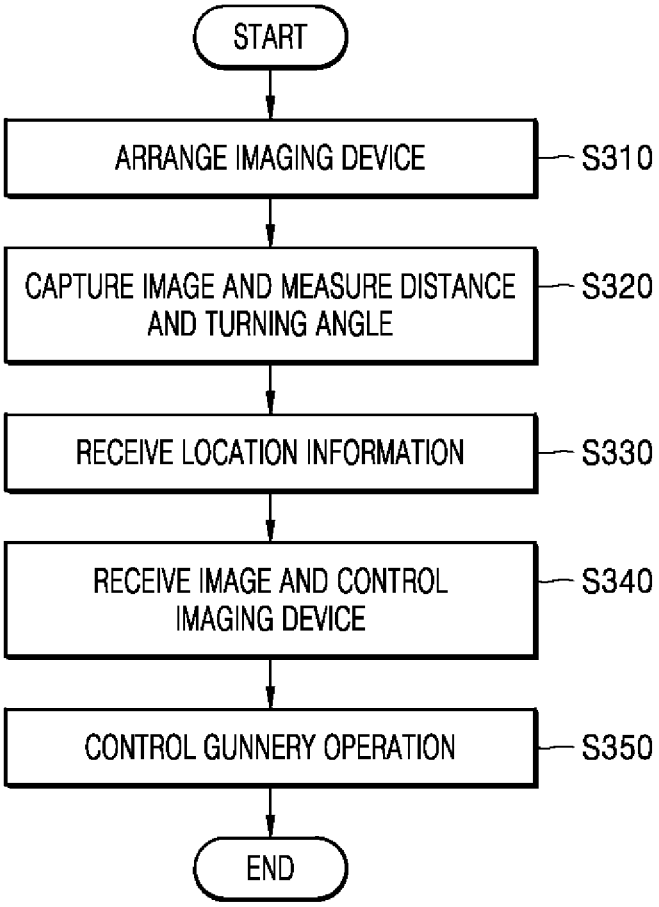
FIG. 8 is a flowchart schematically illustrating an operation sequence of a gunnery control method according to another embodiment.

FIG. 8 is a flowchart schematically illustrating an operation sequence of a gunnery control method according to another embodiment.

Referring to FIG. 8, the gunnery control method according to another embodiment includes a process of arranging an imaging device (S310), a process of photographing and measuring a distance and a turning angle (S320), a process of receiving location information (S330), a process of receiving an image and controlling an imaging device (S340), and a process of controlling a firing operation (S350).

In the above process of arranging the imaging device (S310), the process of photographing and measuring the distance and the turning angle (S320), the process of receiving the location information (S330), and the process of controlling the firing operation (S350), substantially the same operations as those of the above process of arranging the imaging device (S110), the process of photographing and measuring the distance and the turning angle (S120), the process of receiving the location information (S130), and the process of controlling the firing operation (S140) described above with reference to FIG. 6 are performed, and detailed descriptions thereof are omitted.

In the process of receiving the image and controlling the imaging device (S340), the gunnery control apparatus receives an image including the target from the imaging device, and the gunnery control apparatus may control a location or a photographing direction of the imaging device to make the target located at a center of the image.

In addition, in the process of receiving the image and controlling the imaging device (S340), the gunnery control apparatus may receive an image including the gunnery device from the imaging device, and may control the location or the photographing direction of the imaging device to make the gunnery device located at the center of the image.

Here, the gunnery control apparatus may control the target and the gunnery device to be located at the center of the image, and after that, may control the imaging device to measure the distance to the target and the distance to the gunnery device.

Therefore, the camera included in the imaging device may be aligned with the distance measuring device included in the imaging device.

The present disclosure may be implemented as computer-readable codes in a computer-readable recording medium. The computer readable recording medium is any data storage device that may store programs or data which may be thereafter read by a computer system.

Examples of the computer-readable recording medium include Read Only Memory (ROM), Random Access Memory (RAM), Compact Disk-Read Only Memory (CD-ROM), magnetic tape, a floppy disk, and an optical data storage device. Furthermore, the computer-readable recording medium may be implemented as carrier waves (for example, in the case of transmission over the Internet).

The computer readable recording medium may also be distributed over network coupled computer systems so that the computer readable code is stored and executed in a distributive manner. Also, functional programs, codes, and code segments for accomplishing the present disclosure may be easily construed by programmers skilled in the art to which the present disclosure pertains.

Also, the steps of all methods described herein may be performed in any suitable order unless otherwise indicated herein or otherwise clearly contradicted by context. The present disclosure is not limited to the described order of the steps. The use of any and all examples, or example language (e.g., "such as") provided herein, is intended merely to better illuminate the present disclosure and does not pose a limitation on the scope of the present disclosure unless otherwise claimed. In addition, one of ordinary skill in the art would have appreciated that the various modifications, combinations and changes may be constructed according to the design conditions and factors within the claims or scope of equivalents.

While the present disclosure has been particularly shown and described with reference to preferred embodiments thereof, it will be understood by those skilled in the art that various changes in form and details may be made therein without departing from the spirit and scope of the present disclosure as defined by the appended claims. The preferred embodiments should be considered in descriptive sense only and not for purposes of limitation. Therefore, the scope of the present disclosure is defined not by the detailed description of the disclosure but by the appended claims, and all differences within the scope will be construed as being included in the present disclosure.

INDUSTRIAL APPLICABILITY

The present disclosure relates to a gunnery control system and a gunnery control method using the gunnery control system, and more particularly, to a gunnery control system capable of exactly aiming at a target by using a moveable imaging device and a gunnery device, and a gunnery control method using the gunnery control system.

The invention claimed is:

1. A gunnery control system comprising:

a movable imaging sensor configured to photograph a target and to obtain a first distance from the imaging sensor to the target and a first turning angle formed between a first line extending between the imaging sensor and the target and a reference direction;

a gunnery configured to fire at the target, the imaging sensor being discrete from the gunnery and configured to be movable independently from the gunnery; and a controller configured to receive, from the imaging sensor, location information of the imaging sensor, the gunnery, and the target, and to control a firing operation of the gunnery based on the location information of the imaging sensor, the gunnery, and the target, wherein the controller is further configured to control a location and a photographing direction of the imaging sensor and to control a location and a firing direction of the gunnery.

2. The gunnery control system of claim 1, wherein the imaging sensor is further configured to measure a second turning angle formed between a second line extending between the imaging sensor and the gunnery and the reference direction.

3. The gunnery control system of claim 2, wherein the imaging sensor is further configured to measure a second distance from the imaging sensor to the gunnery.

4. The gunnery control system of claim 1, wherein the controller is further configured to determine a gunnery turning angle formed between a third line extending between the gunnery and the target and the reference direction based on the location information transmitted from the imaging sensor.

5. The gunnery control system of claim 1, wherein the imaging sensor comprises a camera and a distance measuring sensor aligned with the camera.

6. The gunnery control system of claim 1, wherein the controller is configured to receive an image including the target from the imaging sensor, and to control the location or the photographing direction of the imaging sensor such that the target is located at a center of the image.

7. The gunnery control system of claim 1, wherein the controller is configured to receive an image including the gunnery from the imaging sensor, and to control the location or the photographing direction of the imaging sensor such that the gunnery is located at a center of the image.

8. The gunnery control system of claim 1, wherein the controller is configured to perform wireless communication with the imaging sensor and the gunnery.

9. The gunnery control system of claim 1, wherein the imaging sensor is further configured to measure a second turning angle formed between a second line extending between the imaging sensor and the gunnery and the reference direction and a second distance from the imaging sensor to the gunnery, and wherein the controller is configured to calculate a third distance between the gunnery and the target based on the first turning angle, the second turning angle, the first distance and the second distance.

10. The gunnery control system of claim 9, wherein the controller is further configured to calculate a gunnery turning angle formed between a third line extending between the gunnery and the target and the reference direction based on the first turning angle, the second turning angle, the first distance, the second distance and the third distance.

11. A gunnery control method using a gunnery control apparatus, the gunnery control method comprising:

arranging a movable imaging sensor around a target;

photographing, by the imaging sensor, the target, and measuring a first distance between the imaging sensor and the target and a first turning angle formed between a first line extending between the imaging sensor and the target and a reference direction;

receiving, by the gunnery control apparatus, location information of a gunnery configured to fire at the target, the imaging sensor, and the target; and controlling, by the gunnery, control apparatus, a firing operation of the gunnery by using the location information, wherein the imaging sensor is discrete from the gunnery and configured to be controlled, by the gunnery control apparatus, to approach the target independently from the gunnery to reduce the first distance.

12. The gunnery control method of claim 11 comprising measuring a second turning angle formed between a second line extending between the imaging sensor and the gunnery and the reference direction.

13. The gunnery control method of claim 12, comprising measuring a second distance from the imaging sensor to the gunnery.

14. The gunnery control method of claim 11, wherein the controlling the firing operation of the gunnery comprises determining a gunnery turning angle of the gunnery formed between a third line extending between, the gunnery and the target and the reference direction based on the location information.

15. The gunnery control method of claim 11, wherein the imaging sensor comprises a camera and a distance measuring sensor aligned with the camera.

16. The gunnery control method of claim 11, wherein the receiving of the location information comprises receiving an image including the target from the imaging sensor, and controlling a location or a photographing direction of the imaging sensor such that the target is located at a center of the image.

17. The gunnery control method of claim 11, wherein the receiving of the location information comprises receiving an image including the gunnery from the imaging sensor, and controlling a location or a photographing direction of the imaging sensor such that the gunnery is located at a center of the image.

18. The gunnery control method of claim 11 comprising performing, by the gunnery control apparatus, wireless communication with the imaging sensor and the gunnery.

19. The gunnery control method of claim 11 comprising:

measuring a second turning angle formed between a second line extending between the imaging sensor and the gunnery and the reference direction and a second distance from the imaging sensor to the gunnery, and calculating a third distance between the gunnery and the target based on the first turning angle, the second turning angle, the first distance and the second distance.

20. The gunnery control method of claim 19 comprising calculating a gunnery turning angle formed between a third line extending between the gunnery and the target and the reference direction based on the first turning angle, the second turning angle, the first distance, the second distance and the third distance.

* * * * *